US009767719B2

(12) United States Patent
Li et al.

(10) Patent No.: US 9,767,719 B2
(45) Date of Patent: Sep. 19, 2017

(54) BILLBOARD OR OTHER LARGE DISPLAYS HAVING ARTWORK ILLUMINATED WITH AN LED BACKLIGHT ARRAY

(71) Applicant: Wavien, Inc., Valencia, CA (US)

(72) Inventors: Kenneth Li, Castaic, CA (US); Seiji Inatsugu, Santa Monica, CA (US)

(73) Assignee: METROMEDIA COMPANY, New York, NY (US)

( * ) Notice: Subject to any disclaimer, the term of this patent is extended or adjusted under 35 U.S.C. 154(b) by 0 days.

(21) Appl. No.: 14/842,386

(22) Filed: Sep. 1, 2015

(65) Prior Publication Data

US 2016/0125772 A1 May 5, 2016

Related U.S. Application Data

(60) Provisional application No. 62/044,673, filed on Sep. 2, 2014, provisional application No. 62/049,618, filed on Sep. 12, 2014, provisional application No. 62/068,932, filed on Oct. 27, 2014, provisional application No. 62/115,782, filed on Feb. 13, 2015, provisional application No. 62/139,259, filed on Mar. 27, 2015, provisional application No. 62/148,968, filed on Apr. 17, 2015, provisional application No. 62/188,878, filed on Jul. 6, 2015.

(51) Int. Cl.

| | |
|---|---|
| ***G09F 15/00*** | (2006.01) |
| ***G09F 13/22*** | (2006.01) |
| ***B44F 1/10*** | (2006.01) |
| ***G09F 13/18*** | (2006.01) |
| ***G09F 13/00*** | (2006.01) |

(52) U.S. Cl.

CPC ..... *G09F 13/22* (2013.01); *B44F 1/10* (2013.01); *G09F 13/005* (2013.01); *G09F 13/18* (2013.01); *G09F 2013/222* (2013.01)

(58) Field of Classification Search

USPC ..... 40/544, 624

See application file for complete search history.

(56) References Cited

U.S. PATENT DOCUMENTS

| | | | | |
|---|---|---|---|---|
| 3,680,238 A * | 8/1972 | Arnold | G09F 13/06 | 40/564 |
| 4,943,689 A * | 7/1990 | Siefer | G06F 3/041 | 178/18.11 |
| 7,063,449 B2 * | 6/2006 | Ward | G02B 6/0048 | 345/102 |

(Continued)

*Primary Examiner* — Joanne Silbermann

(74) *Attorney, Agent, or Firm* — Abelman, Frayne & Schwab

(57) ABSTRACT

A billboard or other large display for displaying information has a billboard frame, an artwork layer, and either a plurality of columns of LED light plates or vertical strips of LED lights. The LED plates are small backlight panels formed in an array covering large areas suitable for standard billboards. The LED plates are secured to one another to hang from the billboard frame in separate columns. The columns are situated between the artwork layer and the billboard frame to provide a backlight for the artwork layer. The artwork layer can include two or more layers such that different artwork is displayed depending on the ambient lighting conditions as well as the backlight operation. The LEDs are preferably controlled by a controller to provide desired backlight conditions as well as to display content.

11 Claims, 42 Drawing Sheets

(56) References Cited

U.S. PATENT DOCUMENTS

| | | | | |
|---|---|---|---|---|
| 2002/0163791 | A1* | 11/2002 | Hoelen | G02B 6/0076 362/616 |
| 2005/0178034 | A1* | 8/2005 | Schubert | G09F 9/33 40/605 |
| 2008/0141572 | A1* | 6/2008 | Tomich | G09F 9/30 40/605 |
| 2011/0056102 | A1* | 3/2011 | Reid | G09F 13/12 40/219 |
| 2012/0120080 | A1* | 5/2012 | Wang | G02B 6/0015 345/520 |
| 2012/0266507 | A1* | 10/2012 | Pendlebury | G09F 13/22 40/544 |
| 2012/0327659 | A1* | 12/2012 | Chi | F21K 9/17 362/249.06 |

* cited by examiner

FIG. 29A
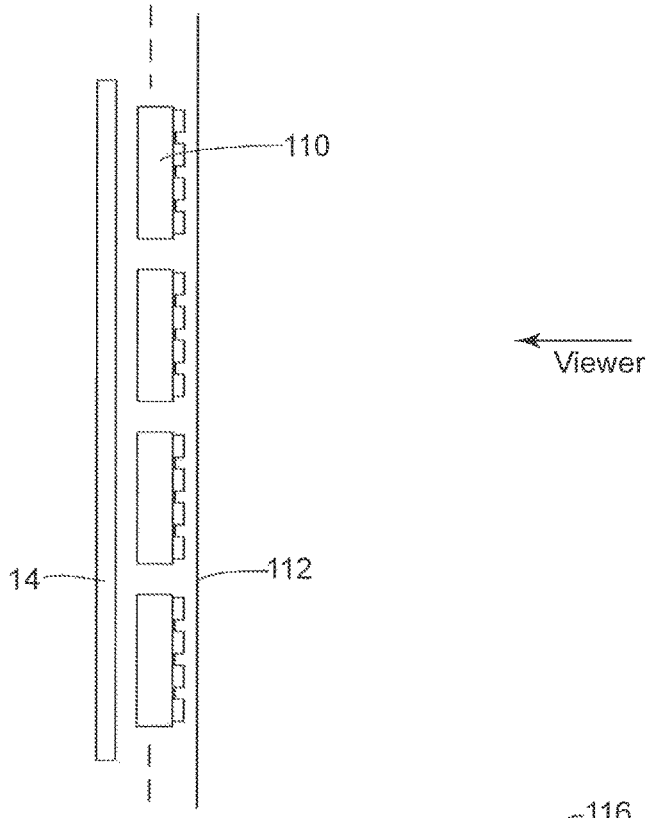
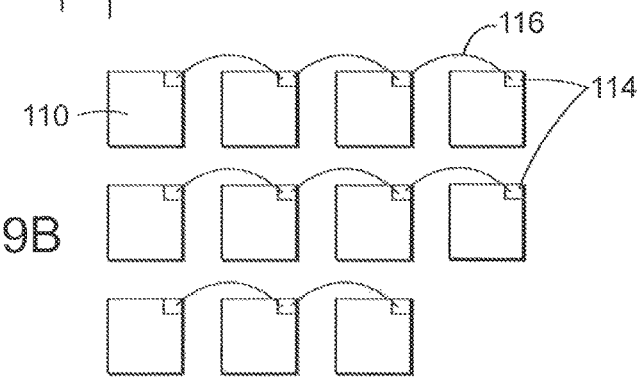
FIG. 29B

BILLBOARD OR OTHER LARGE DISPLAYS HAVING ARTWORK ILLUMINATED WITH AN LED BACKLIGHT ARRAY

CROSS-REFERENCE TO RELATED APPLICATIONS

The present application claims priority on U.S. provisional patent applications:
No. 62/044,673, filed on Sep. 2, 2014;
No. 62/049,618, filed on Sep. 12, 2014;
No. 62/068,932, filed on Oct. 27, 2014;
No. 62/115,782, filed on Feb. 13, 2015;
No. 62/139,259, filed on Mar. 27, 2015;
No. 62/148,968, filed on Apr. 17, 2015; and
No. 62/188,878, filed on Jul. 6, 2015.

BACKGROUND OF THE INVENTION

The present invention relates to billboards or other large displays. Billboards are a type of outdoor advertising found, for example, along major highways. The name refers to large, outdoor steel-framed signs, which in some installations are mounted on poles or on a base to be elevated above the ground. Most often, the artwork (which in the present application includes broadly advertising materials or other content to be displayed) forming the sign is printed on large poster sheets, which are affixed to the face of the billboard. There are hundreds of thousands of billboards in the United States, generating billions of U.S. dollars in revenues.

A billboard frame is typically constructed from steel beams and supports the artwork. If the billboard is to be illuminated at night, typically lighting equipment is mounted in front of the billboard on poles to shine light back towards the billboard. Standard sizes for a large steel frame assembly include 20 feet high×60 feet wide (6.1×18.3 m), 20 feet high×48 feet wide (6.1×14.6 m), 14 feet high×48 feed wide (4.2×14.6 m), and 10 feet high×36 feet wide (3×11 m). The front of the steel frame is covered with a backing material, known as a facing. The artwork is affixed to the facing. The artwork is either preprinted on paper or vinyl sheets that are pasted onto the facing, or in some cases, the art is painted directly onto a plywood or canvas facing.

Billboards designed to display advertising at night have traditionally been illuminated from the front by lamps mounted in front of, and below, the billboard, which shine light back towards the billboard face. Due to the limitation of lamps, the quality of nighttime illumination has been relatively poor. Particularly because billboards are used mostly for advertising purposes, it would be desirable to provide a billboard which can be used at night but with a lighting arrangement better than the current designs.

There are increasing needs for large area displays as digital display technology and billboard print technology improves, which place increase requirements on backlight systems that are low cost and convenient to set up.

SUMMARY OF THE INVENTION

A billboard for displaying information has a billboard frame, an artwork layer, and either a plurality of columns of LED light plates or vertical strips of LED lights. The LED plates are smaller backlight panels formed in an array covering large areas suitable for standard billboards. The LED plates are secured to one another to hang from the billboard frame in separate columns. The columns are situated between the artwork layer and the billboard frame to provide a backlight for the artwork layer. The artwork layer can include two or more layers such that different artwork is displayed depending on the ambient lighting conditions as well as the backlight operation. The LEDs are preferably controlled by a controller to provide desired backlight conditions as well as to display content.

Although the invention is implemented primarily with billboards, it can also be used to provide a backlight with other large displays either indoors or outdoors. They can include displays used in shopping malls, stores, subway stations, bus stops, museums, lobbies, and so on.

Figure 14:
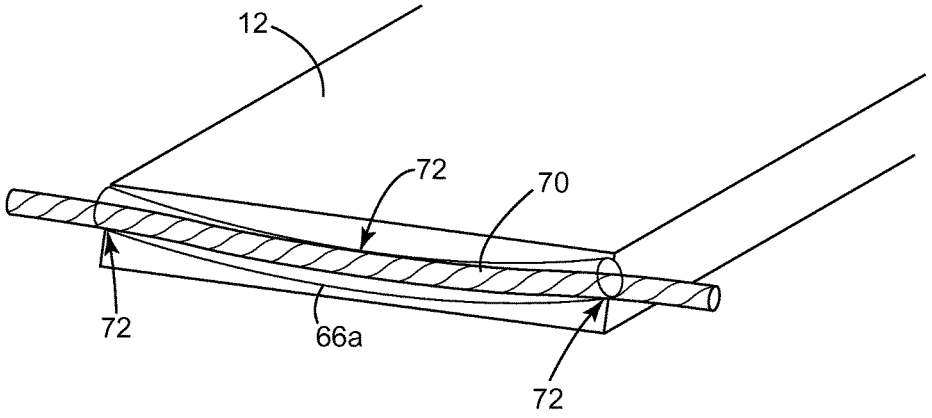
Figure 15:
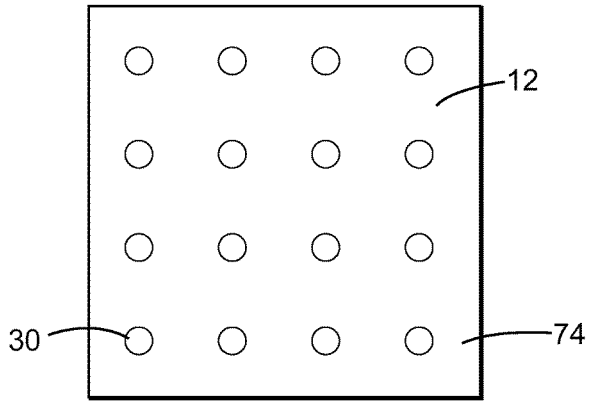
Figure 16A:
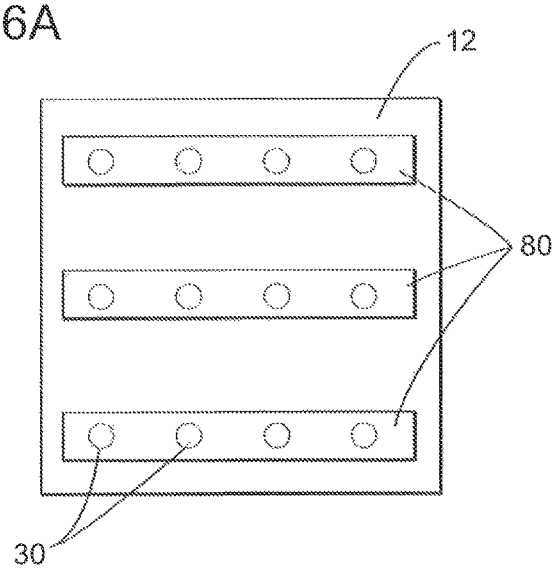
Figure 16B:
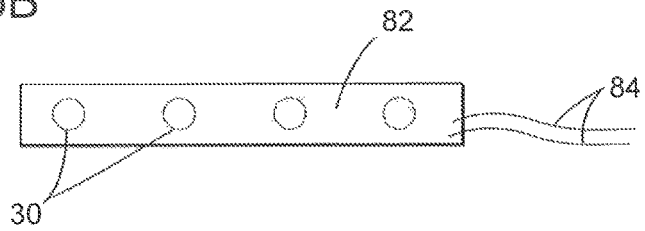
Figure 17:
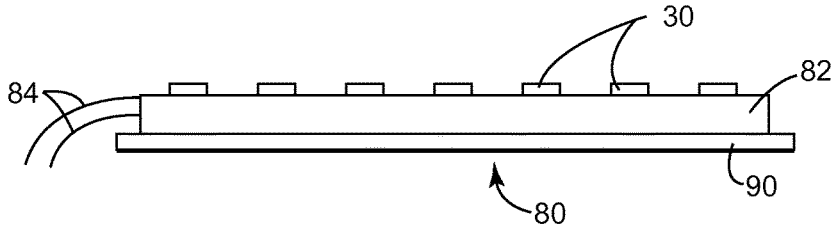
Figure 18:
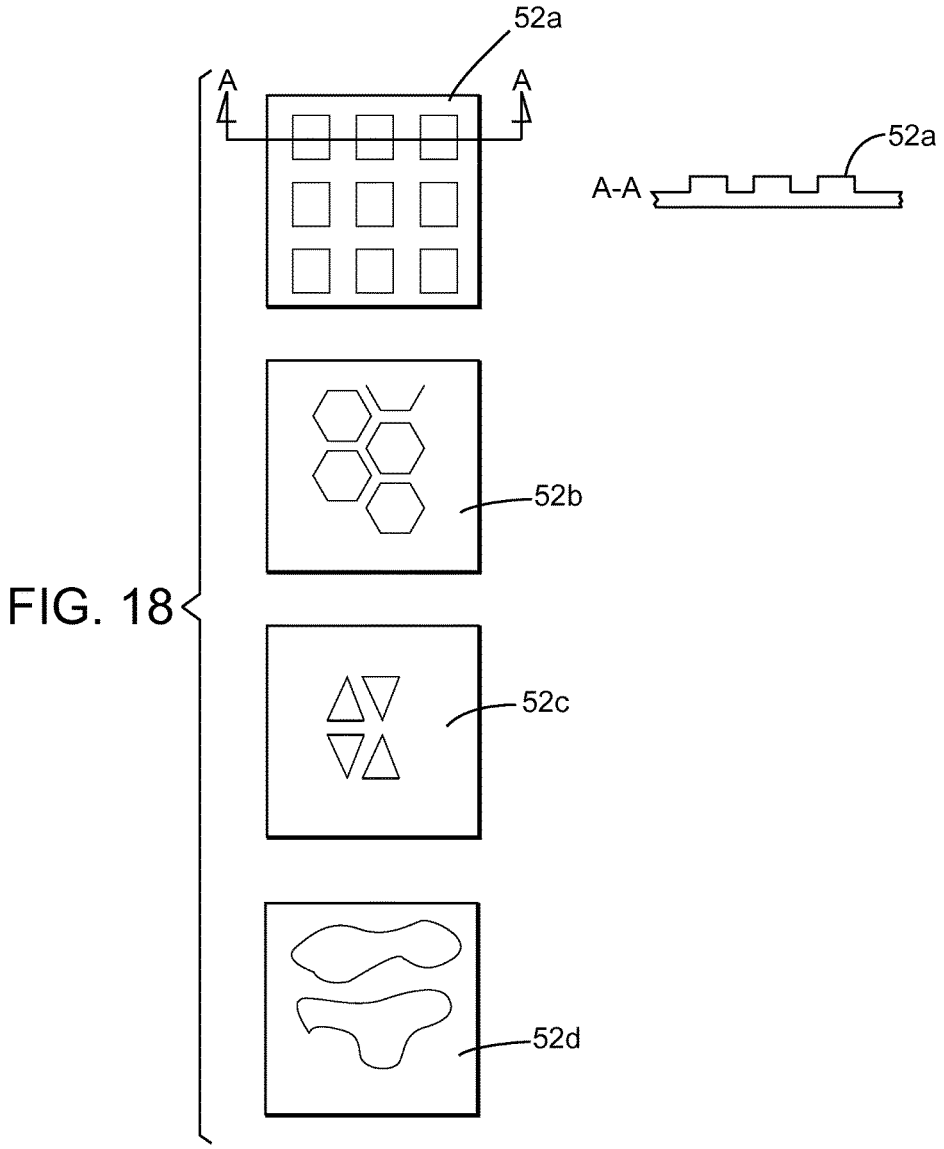
Figure 19:
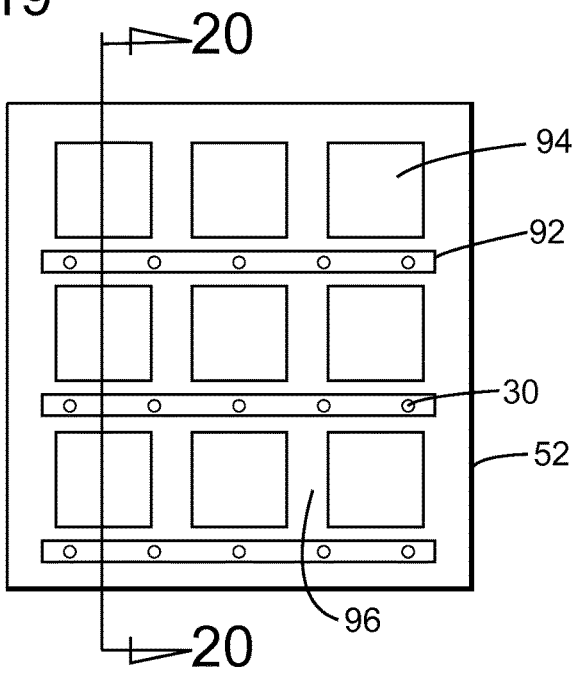
Figure 20:
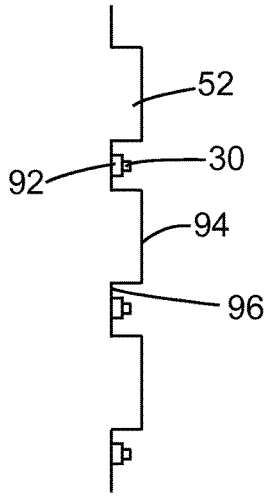
Figure 21:
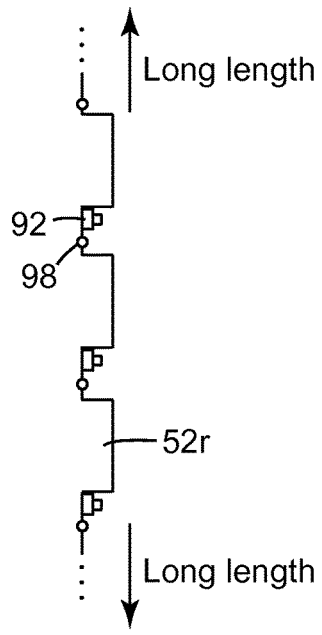
Figure 22:
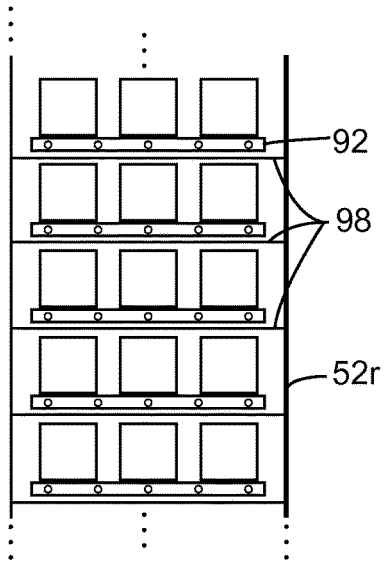
Figure 23:
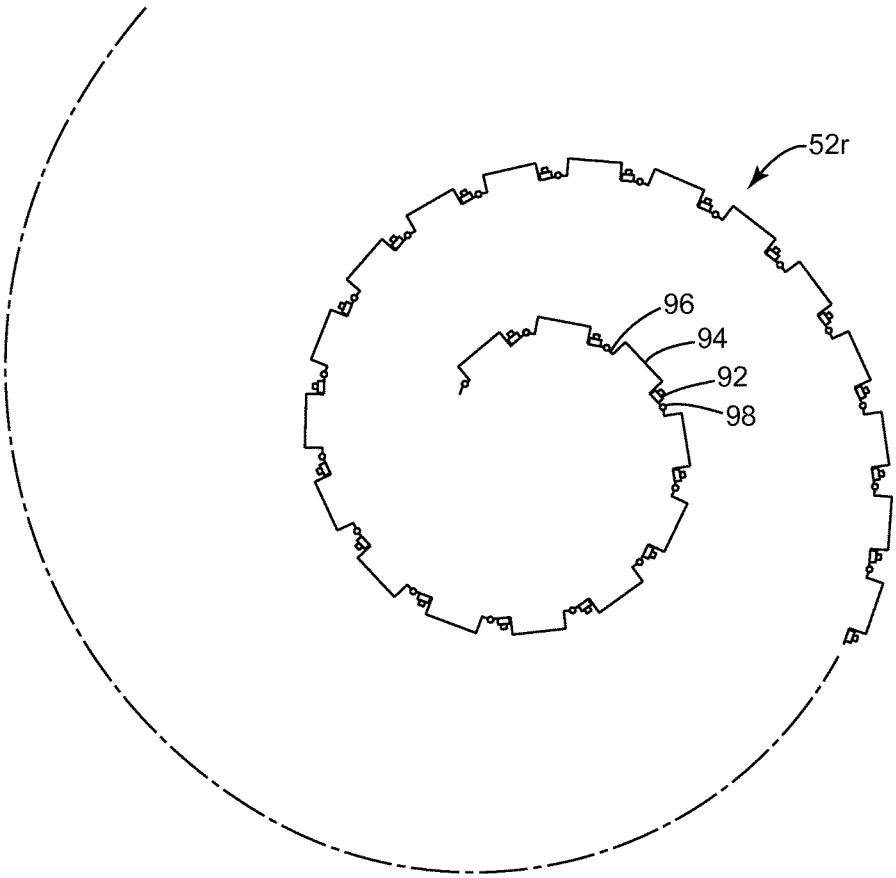
Figure 24:
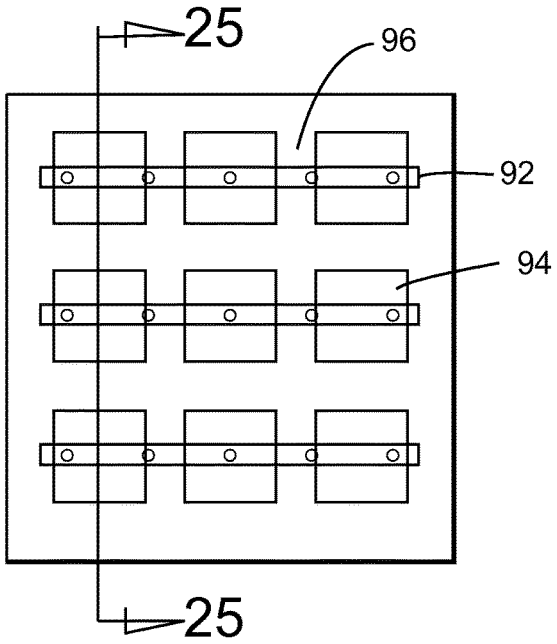
Figure 25:
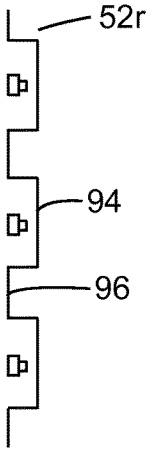
Figure 26:
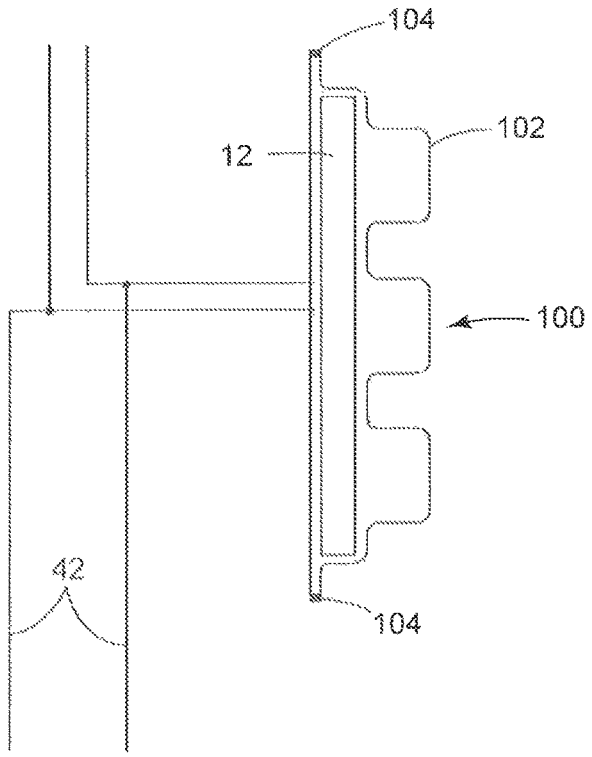
Figure 27:
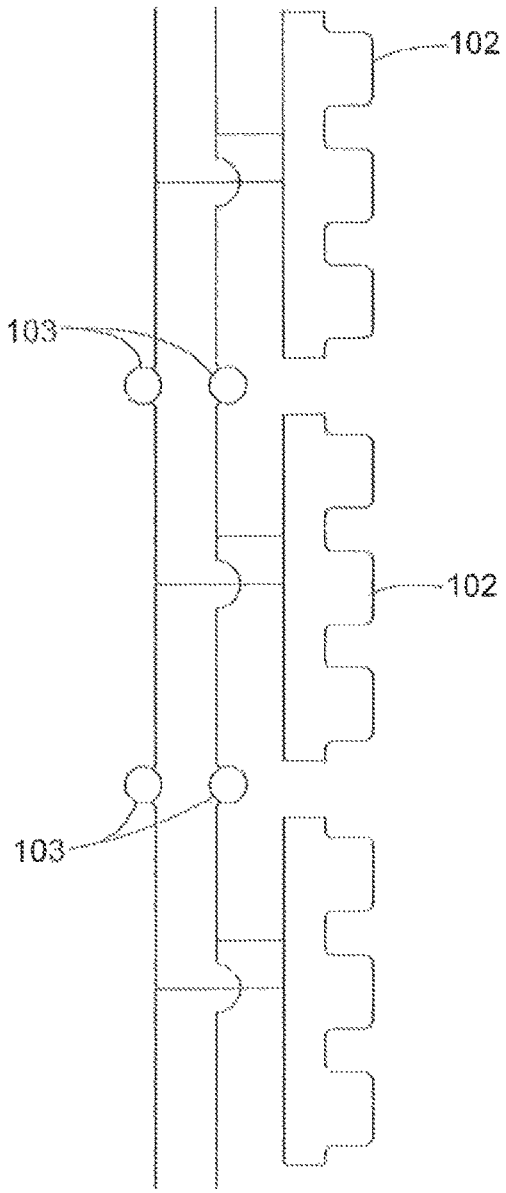
Figure 28:
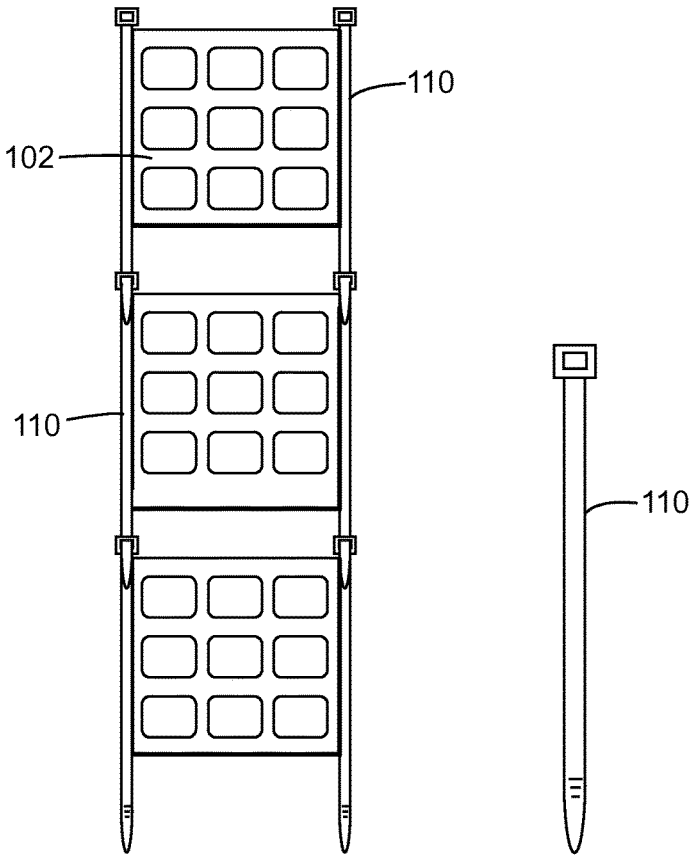
Figure 30:
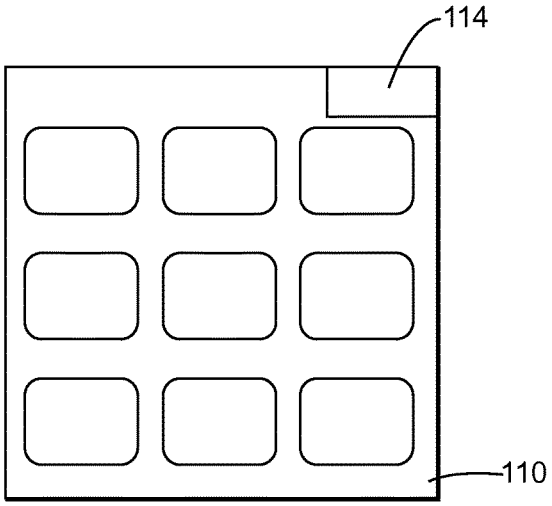
Figure 31:
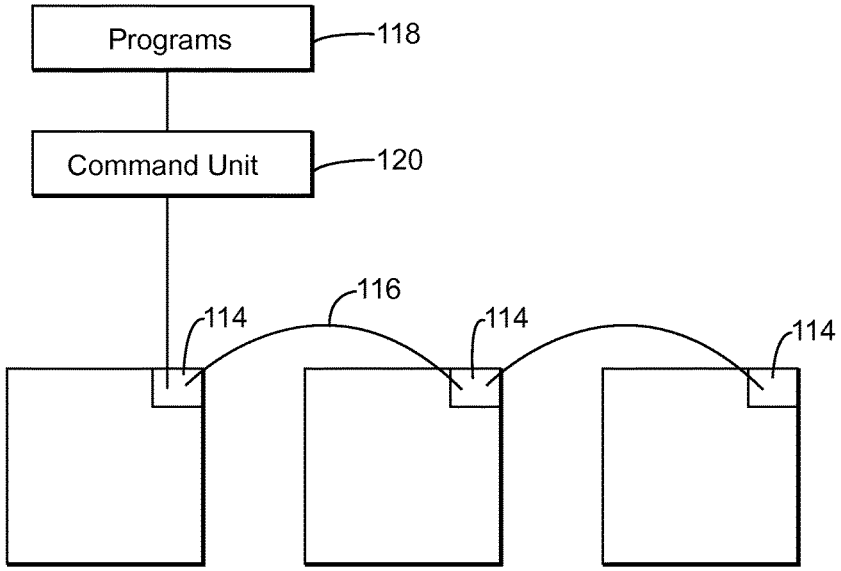
Figure 32:
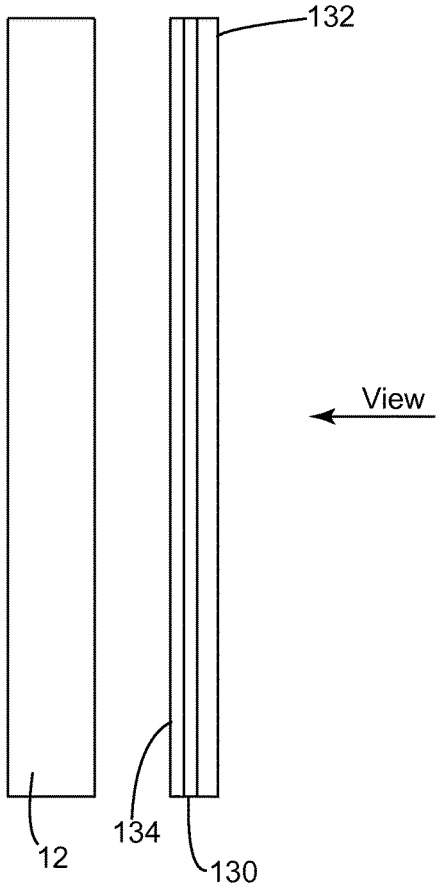
Figure 33:
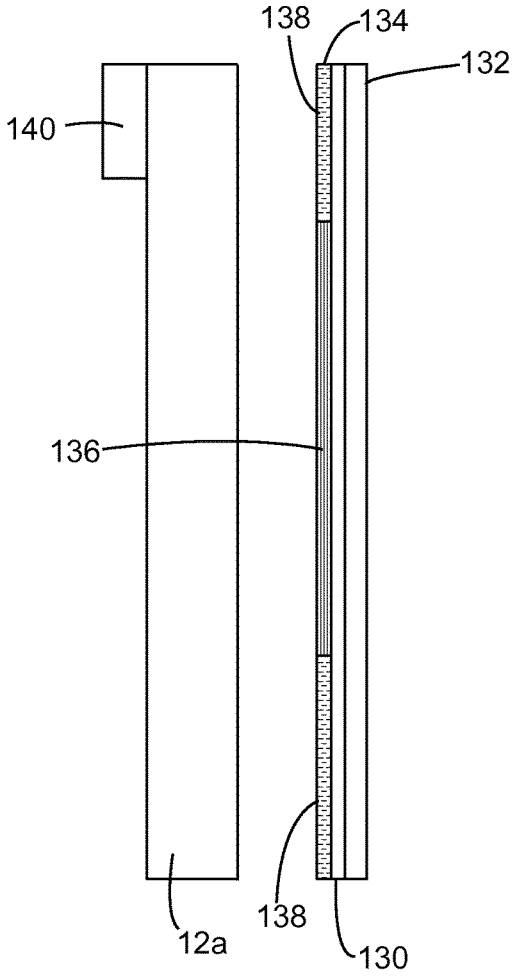
Figure 34:
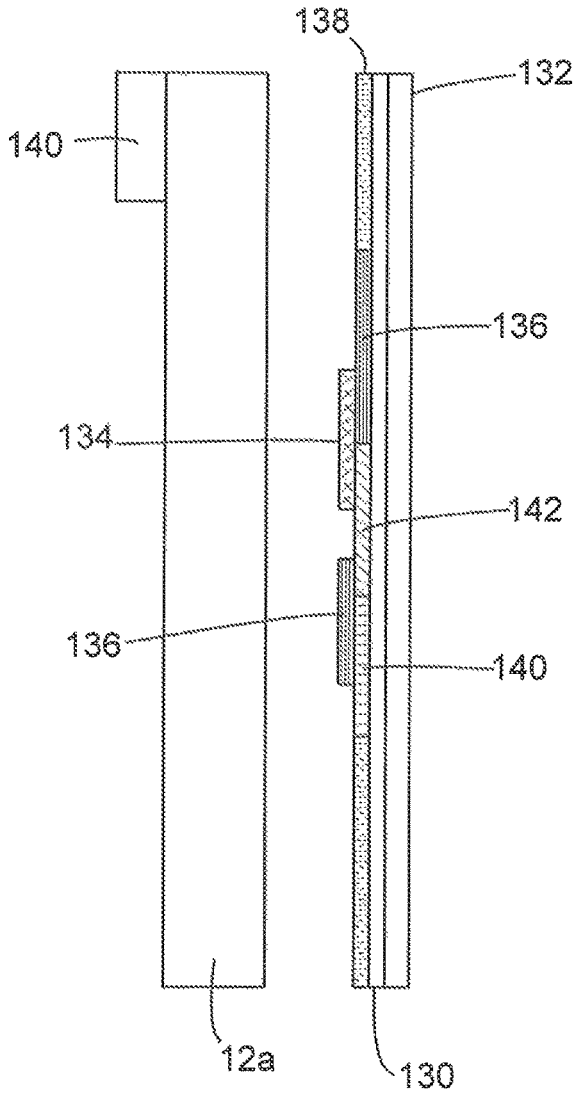
Figure 35:
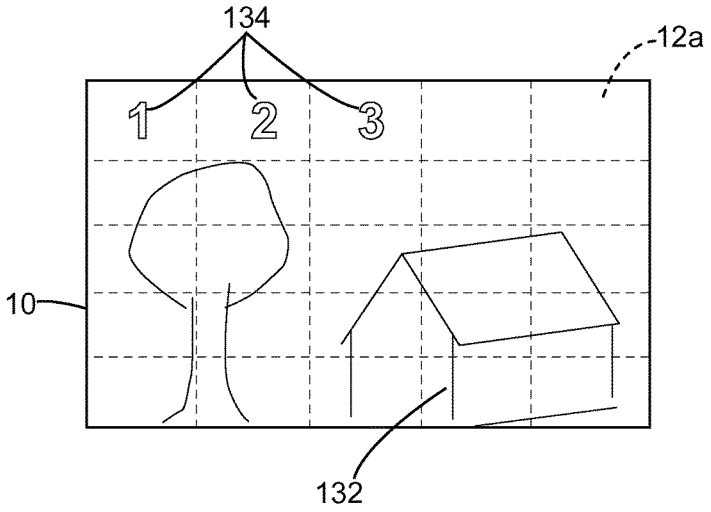
Figure 36:
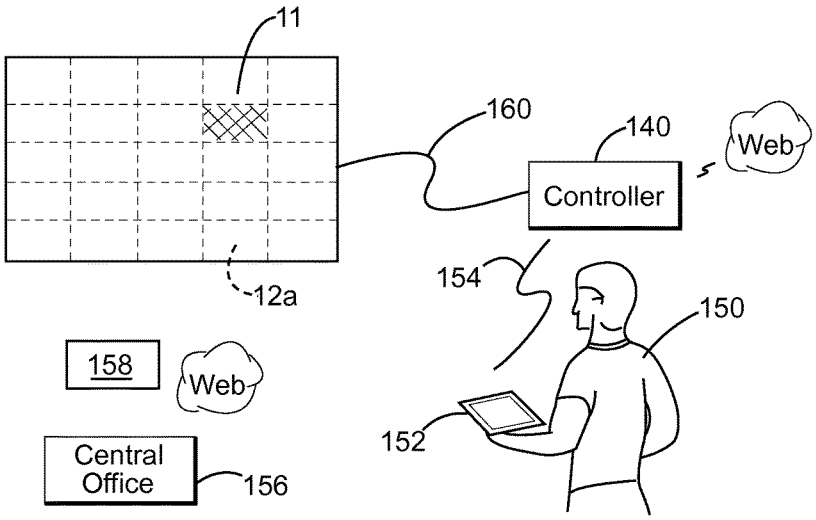
Figure 37:
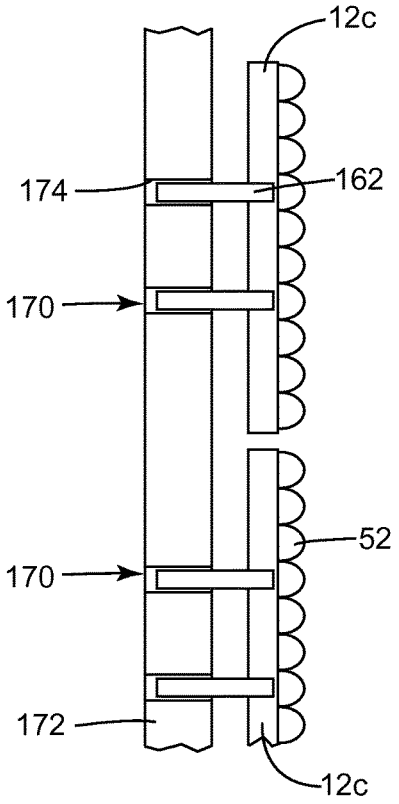
Figure 38A:
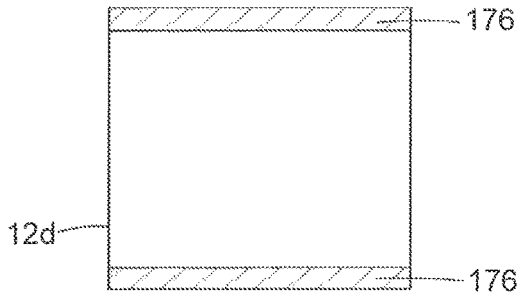
Figure 38B:
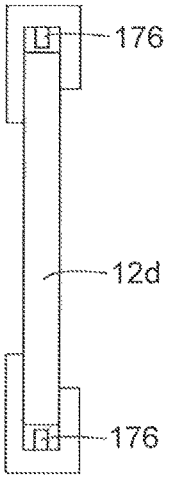
Figure 39A:
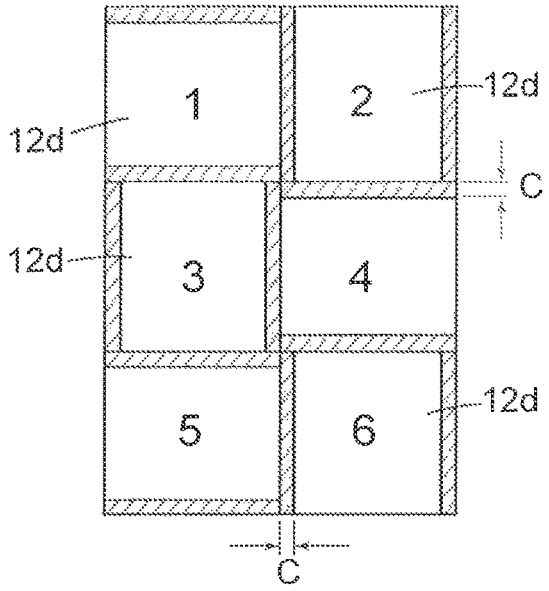
Figure 39B:
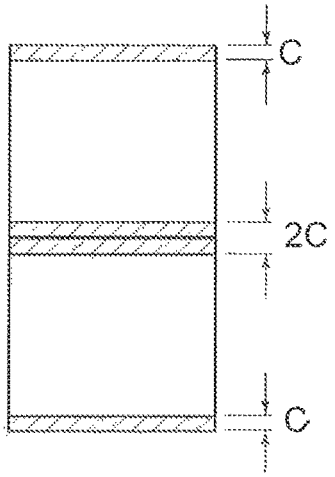
Figure 40:
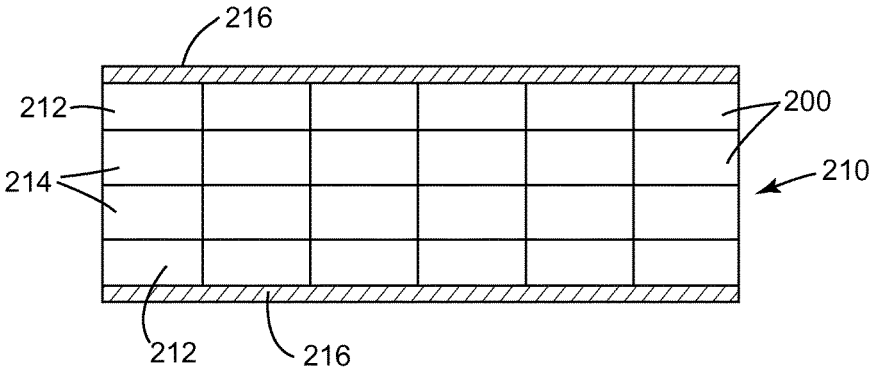
Figure 41A:
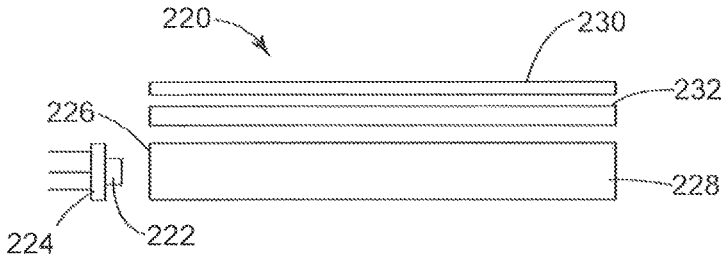
Figure 41B:
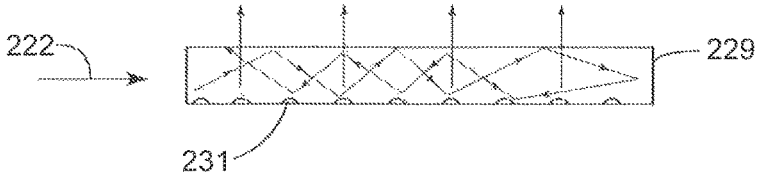
Figure 42A:
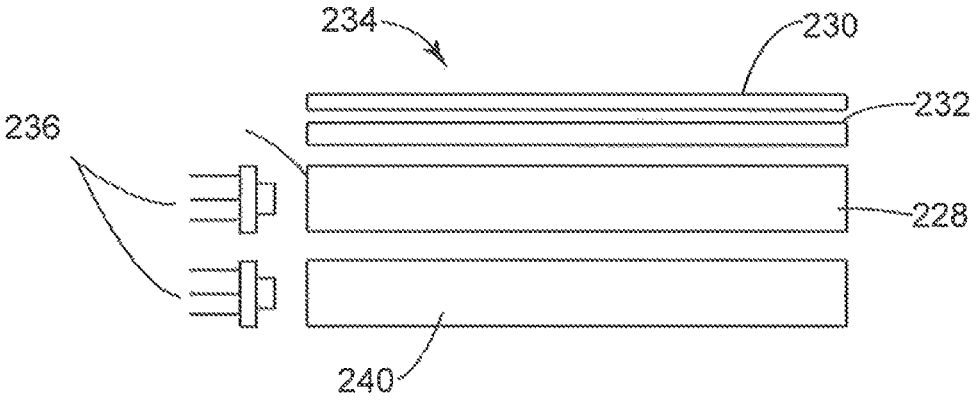
Figure 42B:
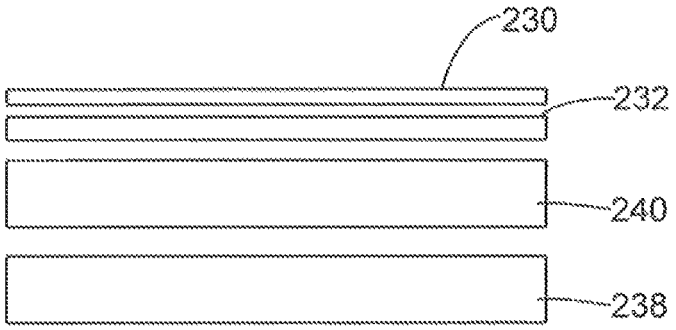
Figure 43:
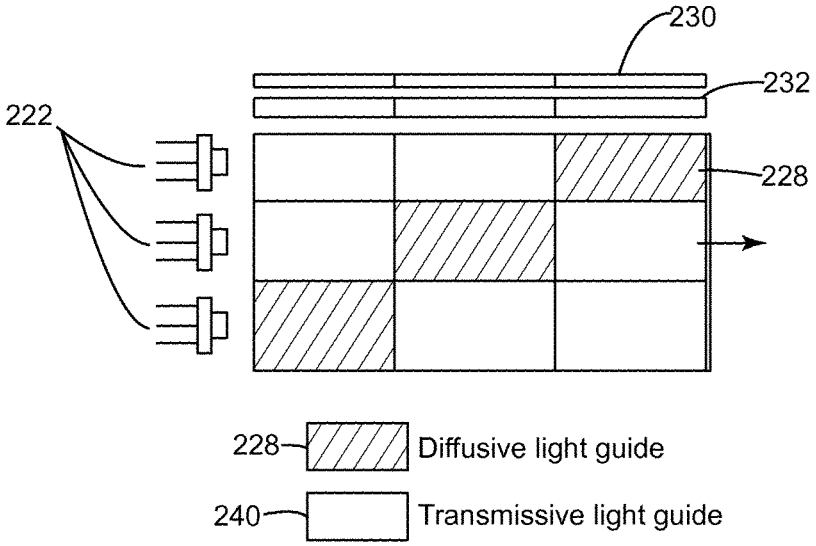
Figure 44:
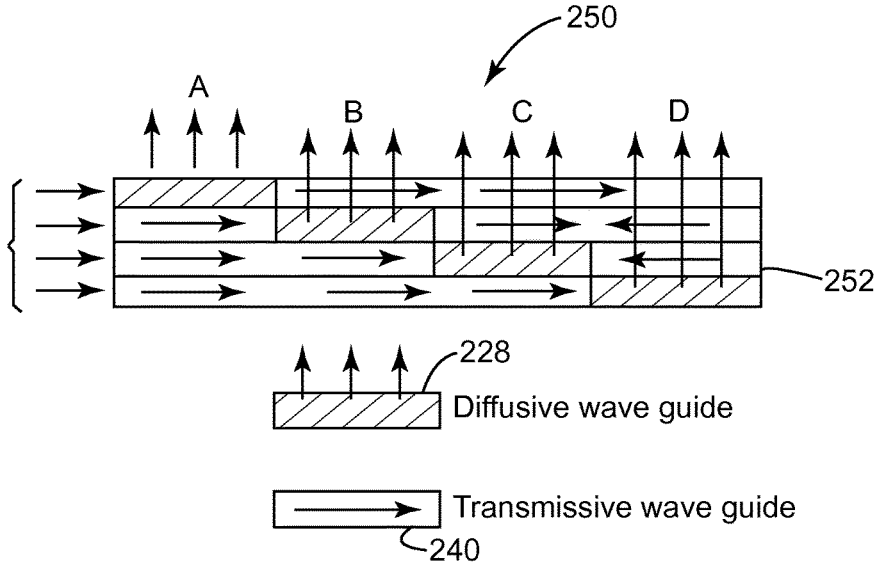

FIG. is a front, schematic view of a portion of an LED backlight array which may be employed with the various embodiments of the invention;

FIG. 14 is schematic, side view of an electrical and mechanical connector for connecting LED light plates in a column which may be employed with the various embodiments of the invention;

FIG. 15 is a schematic, front view of another LED light plate which may be employed with the various embodiments of the invention;

FIGS. 16A and 16B are schematic front and side views, respectively, of another LED light plate which may be employed with the various embodiments of the invention;

FIG. 17 is a schematic, side view of another LED light plate which may be employed with the various embodiments of the invention;

FIG. 18 is a schematic view of various shapes of spacer elements which may be employed with an LED light plate which may be employed with the various embodiments of the invention;

FIGS. 19 and 20 are schematic front, and side views, respectively, of another embodiment of an LED light plate which may be employed with the various embodiments of the invention;

FIG. 21 is a schematic, side view of another embodiment of LED light plate which may be employed with the various embodiments of the invention;

FIG. 22 is a schematic, front view of an LED spacer ribbon which may be employed as the light source with the various embodiments of the invention;

FIG. 23 is a schematic, side view of the spacer ribbon of FIG. 22, which has been rolled up for compact storage and shipping;

FIG. 24 is a schematic, front view of another embodiment of a light source which may be employed with the various embodiments of the invention;

FIG. 25 is a schematic, side view of the light source of FIG. 24;

FIG. 26-27 are schematic, side views of two additional embodiments of light sources which may be employed with the various embodiments of the invention;

FIG. 28 is a schematic, side view of another embodiment of a column of LED light plates which may be employed with the various embodiments of the invention;

FIGS. 29A and 29B are schematic, side and front views, respectively, of another embodiment of an array of LED light plates which may be employed with the various embodiments of the invention;

FIG. 30 is a schematic, front view of another embodiment of an LED light plate which may be employed with the various embodiments of the invention;

FIG. 31 is a schematic, front view of another embodiment of an LED light plate array which may be employed with the various embodiments of the invention;

FIG. 32-34 are schematic, side views of other embodiments of LED light sources and artwork layers which may be employed with the various embodiments of the invention;

FIGS. 35-36 are schematic, front views of other embodiments of billboard display systems which may be employed with the various embodiments of the invention;

FIG. 37 is a schematic, side view of another embodiment of a billboard lighting system which may be employed with the various embodiments of the invention;

FIGS. 38A and 38B are schematic, front and side views, respectively, of another lighting system which may be employed with the various embodiments of the invention;

FIGS. 39A and 39B are schematic, front views of other lighting systems which may be employed with the various embodiments of the invention;

FIG. 40 is a front, schematic view of a backlight array of light plates for a large display which is smaller than a typical billboard;

FIG. 41A is a schematic side view of the display of FIG. 40;

FIG. 41B is a schematic side view of a diffusion plate which can be used in the display of FIG. 41A;

FIGS. 42A and 42B are schematic side views of an end module and a center module for use in the display of FIG. 40; and FIGS. 43 and 44 are schematic side views of alternative embodiments of the display of FIG. 40.

DETAILED DESCRIPTION OF THE INVENTION

Figure 1:
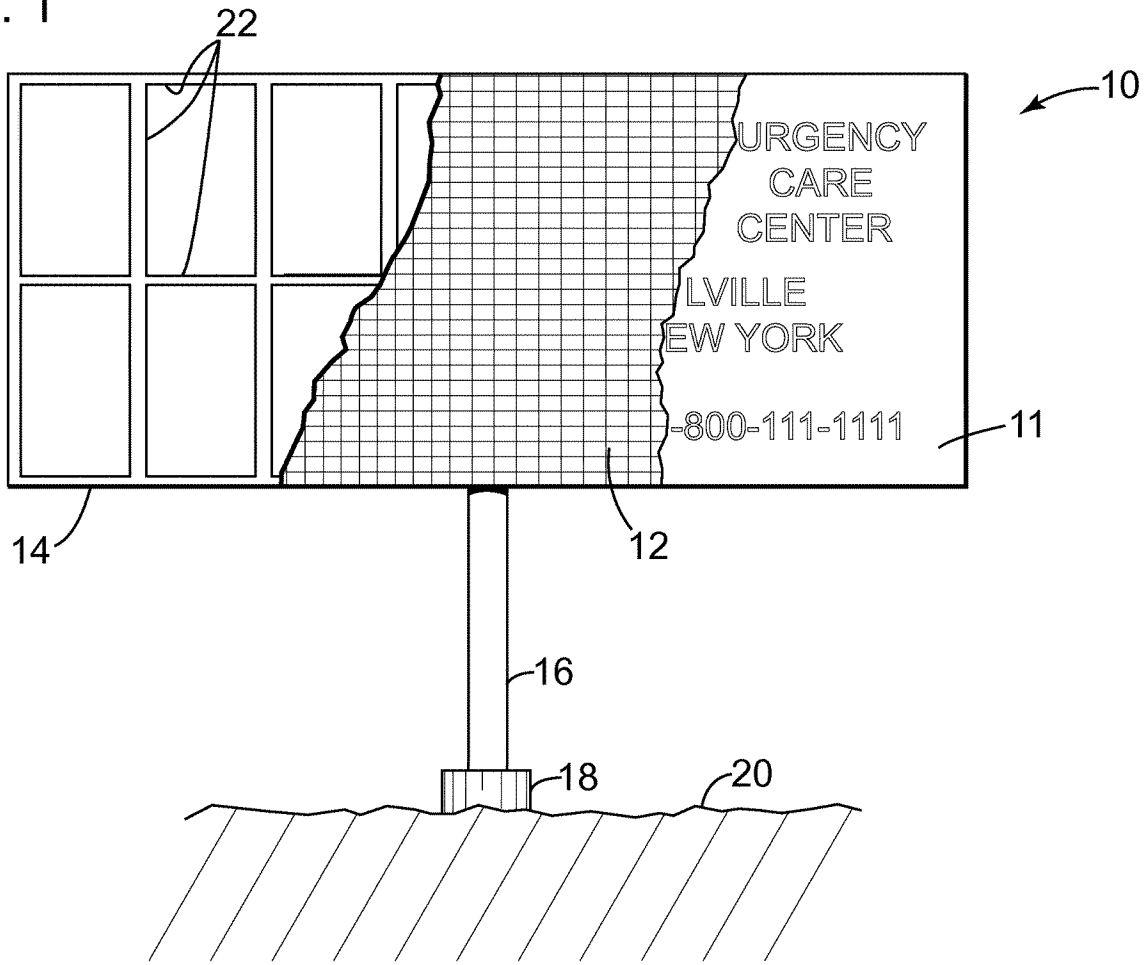
FIG. 1 is a schematic, front view of a billboard according to the invention.

An example of a billboard 10 according to the invention is shown in FIG. 1. The billboard 10 includes a billboard frame 14, an artwork layer 11, and an array of LED light plates 12 between the frame 14 and the artwork layer 11. Part of the artwork layer 11 of the billboard 10, which covers the entire front face, has been omitted to show the backlight array of LED light plates 12 which are mounted under the artwork layer 11. Part of the array of LED light plates 12, in turn, is omitted in order to show the billboard frame 14 which is behind the light plates 12. The frame 14, in turn is mounted on a pole 16 whose lower end is secured in a mounting base 18 secured in the ground 20. The billboard frame 14 is shown as having a steel beam structure 22, but any suitable configuration of billboard 14 may be employed.

Each light plate 12 is relatively small compared to the overall display area of the billboard. For example, for a standard 48 feet by 14 feet billboard, the total area is 672 sq. ft. If each light plate is 1 foot by 1 foot, a total of 672 light plates are preferably employed. These light plates 12 are mounted on the front face of the billboard frame 14. The print contained on the artwork layer 11, which is usually produced by a large inkjet printer using a large vinyl sheet, is placed over the array of light plates.

Figure 2:
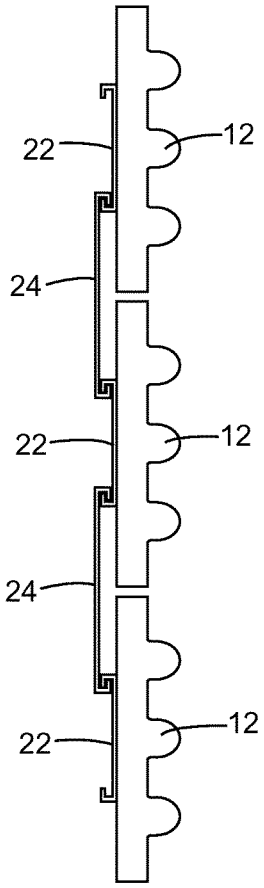
FIG. 2 is a side, schematic view of several light plates which are hung relative to one another to form a column.

FIG. 2 illustrates one system for forming an array of light plates 12. In FIG. 2, the array has mounting hardware so that a plurality of plates 12 are hung vertically relative to one another and, as discussed below, preferably electrically connected to one another. In FIG. 2, each light plate 12 has C-plate 22 attached to its rear side. A floating C-plate 24 attaches to the bottom of each C-plate 22. The C-plate 22 and corresponding floating C-plate 24 are oriented oppositely one another so as to hook together. The C-plate 22 of the next lower light plate 12 is then hooked into the lower end of the floating C-plate 24 to attach the next light plate to the array. In the example where the array is a 48×14 foot billboard, 14 light plates 12 are hooked together for each column. A total of 48 columns of light plates 12 are formed. The upper end of the fixed C-plate of the topmost light plate 12 of each column is then hung from appropriate hardware located at or near the top of the billboard frame. The fixed C-plate can also be implemented using 2 separate plates with only one hook on each plate.

It would be evident to a person skilled in the art how to connect columns of light plates 12 to one another; how to hang the top-most light plate 12 of each column from the billboard frame 14; and how to secure each of the columns relative to one another to provide stability to the array of light plates 12 when assembled relative to the billboard frame 14. Moreover, other types of hardware may be employed to secure the plates 12 to one another. For example, screws, rivets, welding, wires, ties, or other known hardware, or various types of adhesive, may be employed to hold the light plates 12 together when mounted on the billboard frame 14. The types of hardware and/or adhesive may also vary depending on the type of outdoor environment in which the billboard 10 will be used.

FIG. 2 shows an array of light plates 12 where in each column the light plates are aligned vertically with the plate above it and below it. However, if desired the plates in each column can be offset horizontally from one another either in a regular pattern, such as in a zig-zag pattern, or randomly. However, they are configured, the light plates 12 of each column should be positioned as close as possible to the light plates 12 of the adjacent columns.

Figure 3A:
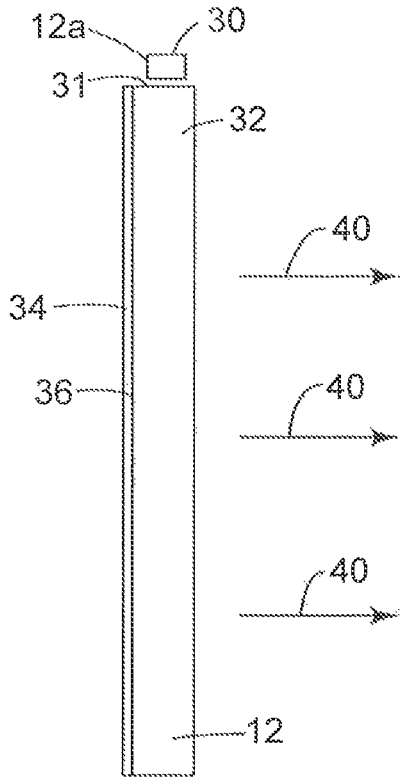
FIGS. 3A and 3B are schematic side and front views, respectively, of an LED light plate which may be employed in the various embodiments of the invention.
Figure 3B:
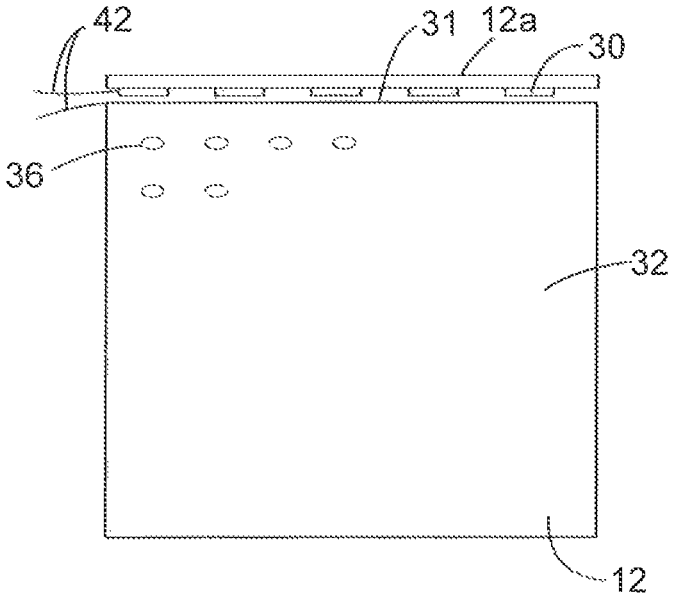
Figure 3C:
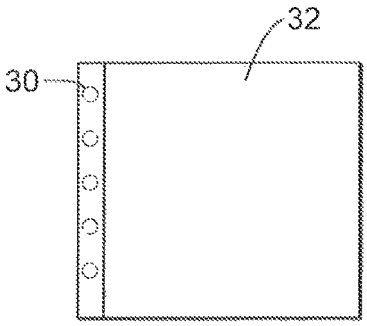
FIG. 3C is a schematic front view of another LED plate which may be employed with the various embodiments of the invention.

FIGS. 3A through 3D illustrate two examples of LED light plates 12*a* and 12*b* which may be used with the invention. FIGS. 3A and 3B show an edge-lit configuration in which an array of LEDs 30 are lined-up in a linear fashion along one edge 31 of a waveguide/diffuser plate 32. A rear side 34 of the plate 32 has a scattering mechanism 36 which reflects and diffuses light toward the front side 38 of the plate 32 so that it is emitted as rays 40 in a general first direction 40 which is away from the billboard frame 14. The LED array is connected by wires 42 to a power source (not shown) to power and control the operation of the LEDs 30.

The light emitted from the LEDs is partly guided, spread across the emissions area, and redirected out of the plate perpendicular to the plate. There are many types of methods achieving such function, including etched lines or dots on the plate, and wedged plates for controlled total internal reflections with light emissions. The light from the LED entering the diffuser plate will be spread by various diffusion mechanisms such that each LED will cover a certain area with light with overlapping regions between the LEDs. The diffuser provides a uniform intensity profile across the surface of the plate.

Figure 3D:
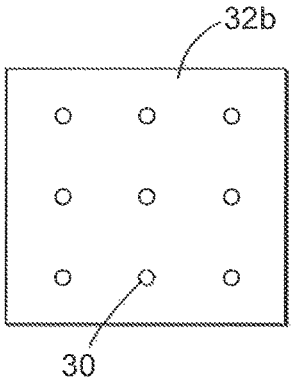
FIG. 3D is a schematic front view of another LED light plate which may be employed with the various embodiments of the invention.

FIG. 3D shows an alternative of an LED light plate 12*b* in which an array of LEDs 30 is spread out across the back side of a diffuser plate 32*b* to produce different light outputs in the direction of the diffuser plate 32.

Figure 4:
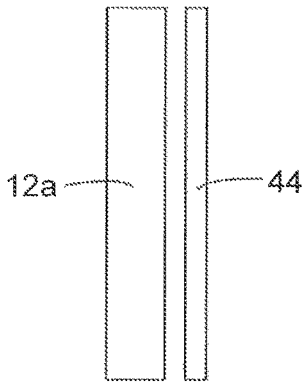
FIG. 4 is a schematic side view of another LED light plate with an additional diffuser which may be employed with the various embodiments of the invention.

FIG. 4 shows an arrangement in which an LED light plate 12*a* or 12*b* is used in conjunction with an additional diffuser 44. The diffused angular distribution can be symmetrical in the x and the y directions. In certain designs, the angular distributions can be different in the x and the y directions (that is, the horizontal and vertical directions). For example, it might be desirable to have larger horizontal viewing angle than the vertical viewing angle.

Edge-lit backlight panels are advantageous because edge-lit backlight panels have higher efficiency and lower cost. The disadvantage of an edge-lit backlight panel is that it does not allow illumination of very large areas. As a result, in the present invention, where edge-lit backlight panels are preferably used to provide backlight to the artwork used in the billboard, a relatively large number of LED plates 12 is used to form the lighting array for the billboard. Even if back lit LEDs are used, the panels are kept relatively small compared to the size of the billboard because, as described below, smaller panels can be folded and transported to the billboard sight more easily than larger light panels.

Figure 5:
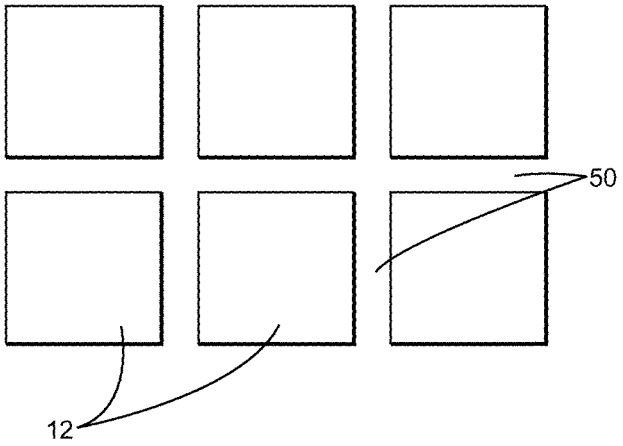
FIG. 5 is a front schematic view of part of an array of small LED light plates hung in adjacent columns which may be employed with the various embodiments of the invention.

Due to practical reasons, a small gap 50 between the light plates is expected, as shown in FIG. 5. The gaps, which are not illuminated, will appear as dark line on the illuminated print. This is not desirable. The present invention preferably employs the diffuser plate 44 described above to help create a relatively uniform output of light which is directed towards the artwork layer 11 and fill the gaps.

Figure 6:
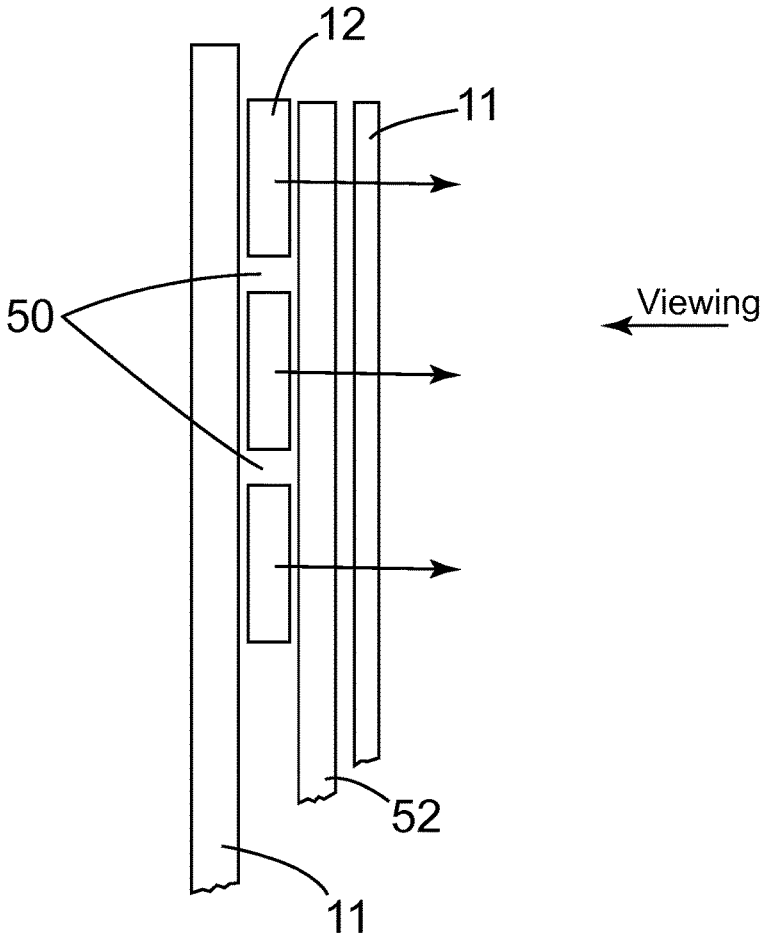
FIG. 6 is a schematic, side view of another embodiment of billboard, LED light plate array, and spacer which may be employed with the various embodiments of the invention.

FIG. 6 shows an embodiment in which a spacer 52 is placed between the light plates 12 and the artwork layer 11. The light plates on both sides of the gap will have divergent light outputs and spread as they travel through the spacer 52, designed with appropriate thickness, covering the gap with light. As a result, the gaps as viewed from the direction "V," i.e., the front of the billboard through the artwork layer 11, will not be dark as they are illuminated by the light plates on both sides. The resulting print will then be illuminated uniformly from behind by the light plates 12.

Figure 7:
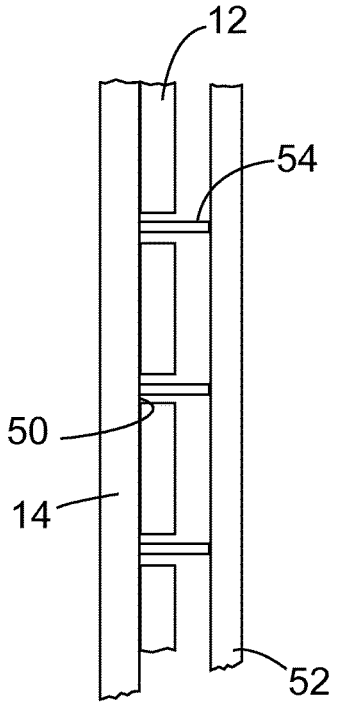
FIG. 7 is a schematic, side view of another embodiment of billboard, LED light plate array, and spacer which may be employed with the various embodiments of the invention.

FIG. 7 shows an embodiment in which the spacer 52 is secured to the billboard frame 14 by a plurality of posts 54 spaced appropriately across the entire billboard so that the posts 54 extend outwardly from the billboard frame 14 through the gaps 50 between the light plates 12.

Figure 8A:
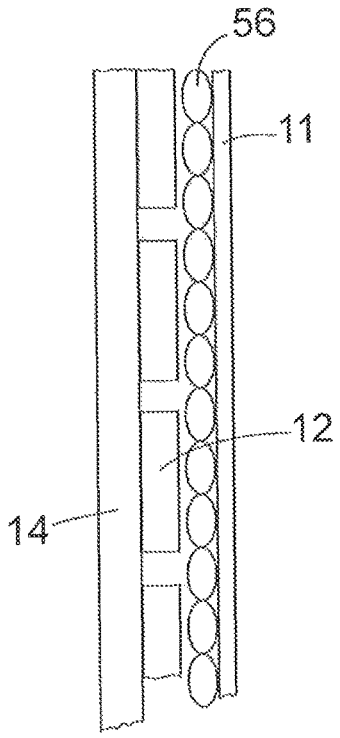
FIGS. 8A and 8B are schematic, side views of other embodiments of billboards, LED light plate arrays, and spacers which may be employed with the various embodiments of the invention.

FIG. 8A shows an alternative embodiment in which a spacer 56 is made using air pockets. One such air pocket material is commonly used plastic bubble wrap. Bubble wraps are made with various sizes of bubbles and when chosen appropriately, the proper spacer gap can be achieved. Bubble wraps are usually made with clear plastic sheets in which the air pockets are made. When needed, multiple layers of small air pockets can be used instead a single layer of large air pockets.

Figure 8B:
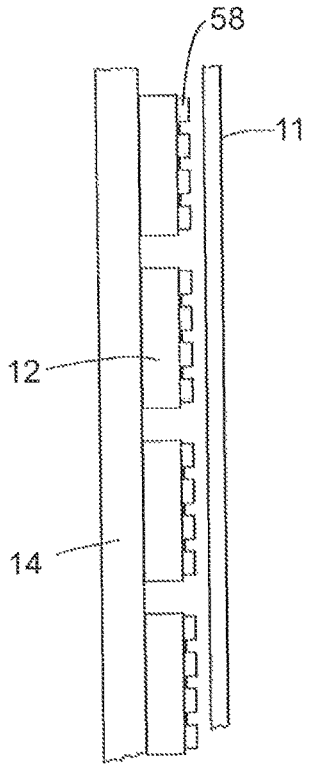

FIG. 8B shows another embodiment in which the spacer 58 is made with vacuum formed sheet of clear plastic with structured features, e.g., hills and valleys, forming the spacer. Such spacer 58 can be mounted directly on top of each light plate 12.

Figure 9:
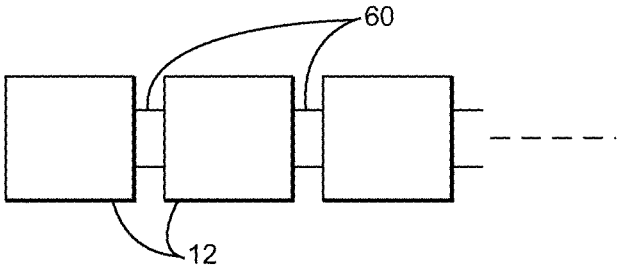
FIG. 9 is a schematic, front view of another embodiment a vertical column of LED light plates which may be employed with the various embodiments of the invention.

As shown in FIG. 9, in order to facilitate installation of the light plates onto the billboard, the light plates are preferably connected electrically by connectors 60 as a linear array. For example, 14 light plates 12 are hung as one column of plates. The plates 12 in each column are connected and supported relative to one another both mechanically and electrically by the connectors 60 such that they can be stored in a compact fashion for transportation and each light place can be driven from only one end of the array.

Figure 10:
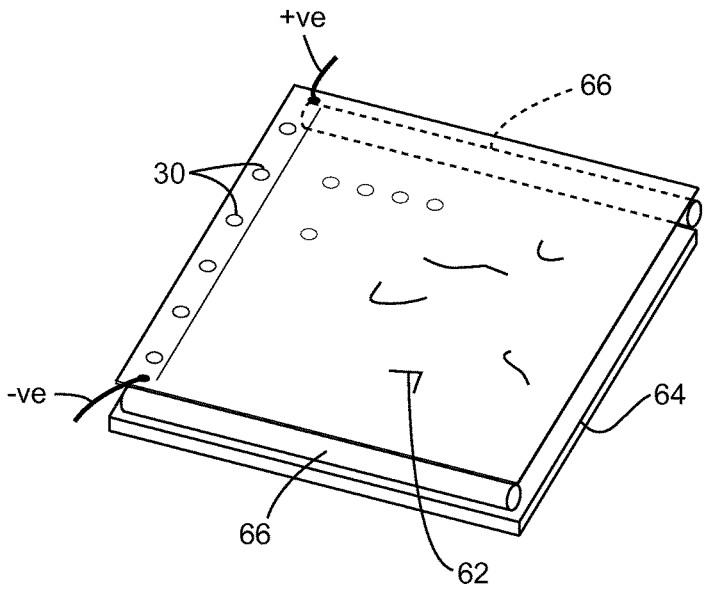
FIG. 10 is a schematic, perspective view of another light plate which may be employed with the various embodiments of the invention.

FIG. 10 shows an embodiment of a light plate 12 used in this invention. The light plate 12 includes a transparent acrylic plate member, with scattering features 62 such as an etched pattern formed on one side of the plate and a back diffuser 64. An array of LEDs 30 is placed along one edge of the acrylic plate such that the LED light outputs are coupled into the light plate. The scattering features are designed such that the light output from the array of light plates 12 is spatially uniform. On the two sides of the light plate as shown, a metal tube 66 is mounted on each side. The metal tubes 66 are then connected to the LEDs 30 in the array and act as +ve and −ve electrodes.

Figure 11:
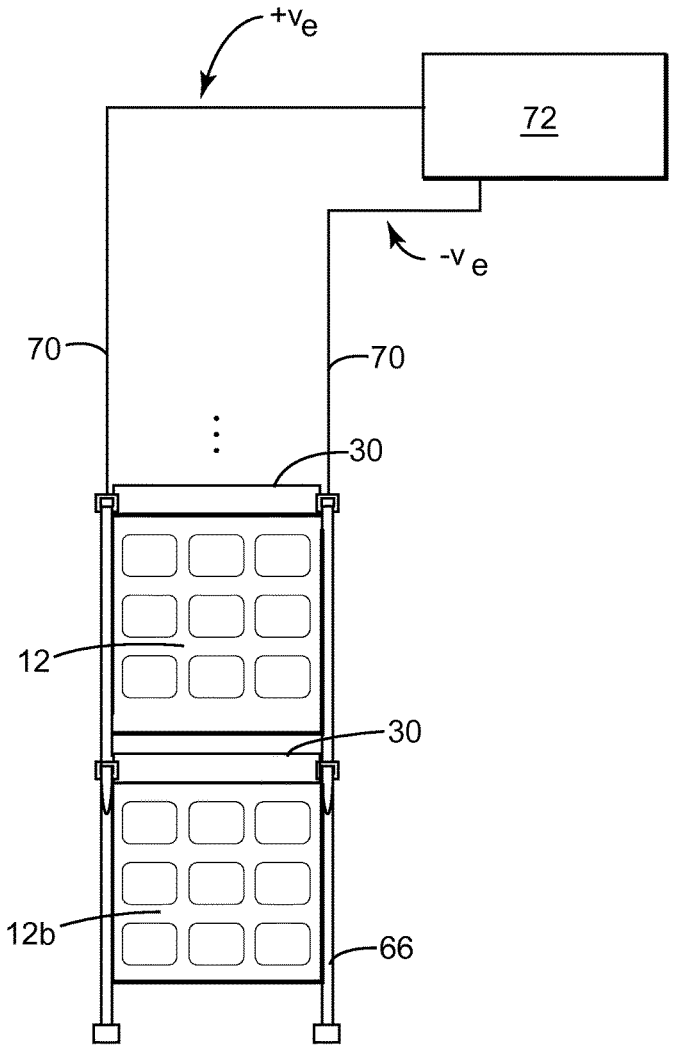
FIG. 11 is a front, schematic view of another LED light plate column which may be employed with the various embodiments of the invention.

FIG. 11 shows one embodiment of how the light plates 12, including the bottom plate 12*b*, are connected together to form one of the columns. Two metal wires 70, single or stranded, are fed through the metal tubes 66 such that all +ve electrodes are connected together and all −ve electrodes are connected together. As a result, each column of light plates 12 which form the complete light plate array will have a single pair of electrodes for connection to a single power supply. The metal wire and the metal tubes are in intimate contact such that the LED can be driven by the power supply connected to the metal wires.

Figure 12:
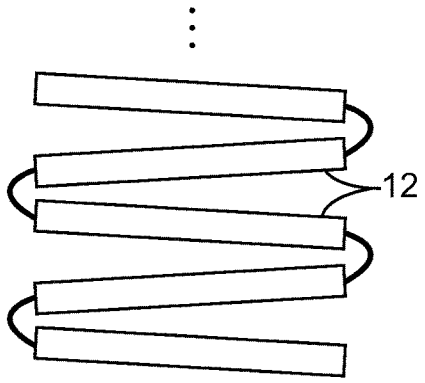
FIG. 12 is a front, schematic view of the LED light plate column shown in FIG. 11, but in folded condition for shipping and storage.
Figure 13:
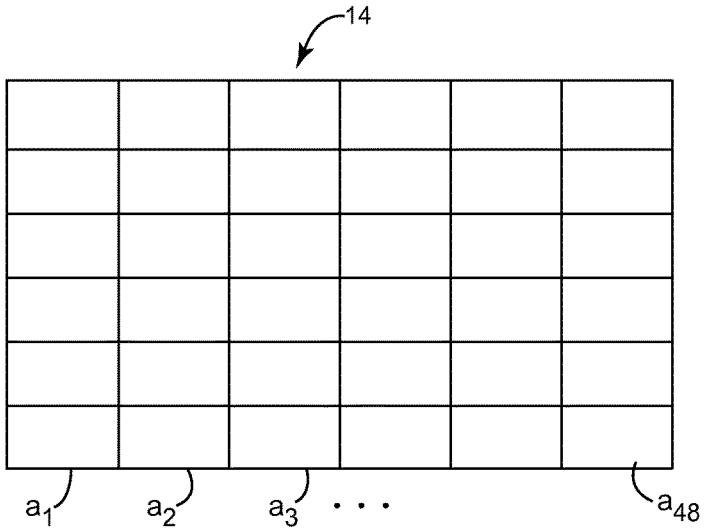

For transportation, each column of light plates 12 of FIG. 11 is folded in a zig-zag manner as shown in FIG. 12. The array of light plates 12 is installed by stretching each column a1, a2, a3, a48, to hang from the top of the billboard frame 14 as shown in FIG. 13 next to an adjacent column of LED light plates, e.g., such that column a1 hangs next to column a2. Because the metal wires are sliding inside the metal tubes, when the array is hung from the top of the billboard, the light plates will automatically form a closely spaced vertical array with virtually no gap in between. When 48 such arrays are installed, the full 48 feet by 14 feet billboard will be covered with the light plates.

To reduce the electrical resistance between the metal wire and the metal tube 66*a*, the tube 66*a* is preferably slightly curved as shown if FIG. 14. When the metal wire 70 is held inside the curved metal tube 66*a* under tension after installation, the metal wire will be pressed against the inside of the metal tube with pressure at contact points 72, forming a sufficiently good electrical contact.

In addition to attaching each column of light plates to the upper portion of the billboard frame 14, it is desirable to attach the lower portion to the frame as well. Depending on the application, it may be desirable to secure intermediate portions of each column to the billboard frame 14 too.

The light plate 12 described above can be driven by white LEDs, colored LEDs (e.g. red, green, blue, yellow), and the various colored LEDs and white LEDs can be used singly or in combinations with one or more colors in the same light plate. The LEDs used can be single color or multi-color with multiple chips mounted on the same substrate. For example, a common colored LED has 4 chips, red ("R"), green ("G"), blue ("B"), and white ("W"), mounted in the same package and preferably separately driven in order to selectively vary the color output.

Since the light array is implemented using individual light plates, each plate, either white or colored, can be driven separately by its own drivers, such that the color and intensity can be controlled by computer creating a multitude of visual effects. For a standard billboard of 48 feet by 14 feet, using a 1 foot by 1 foot light plate, there is a total of 672 controllable "pixels". If 6-inch by 6-inch light plates are used, there will have four times as many pixels, total of 2,688, and high resolution visual effects can be created. A text message with 7 rows of 32 characters can be displayed. Smaller "pixel" sizes can be created using smaller light plates, by sub-dividing each plate into multiple controllable regions, With the pixels, digital messages can be displayed underneath and transmitted through the artwork layer 11. The pixels can also be programmed to provide special, eye-catching patterns, to attract attention to the billboard. Other effects like flashing pixels, vertical or horizontal movement of columns and rows of pixels, etc. can be implemented. Contrast can be increased using variable intensity backlight matched to the content of the scene. In this case, the light plate intensity can also be varied matching to the printed content and creating better contrast to the picture and other special effects.

The system can also be implemented using a light panel that is populated with LEDs 30 on the front surface 74 (i.e., the surface which faces the artwork layer 11) of the light plate 12 as shown in FIG. 15. In this case, the plate does not have to be transparent or light guiding. Instead, it can be a circuit board or simply a board with LEDs 30 mounted in an array fashion and in any other arrangements deems appropriate. The LEDs 30 can be white, single colored or multi-colored and can be controlled as a single unit, or be controlled individually.

FIGS. 16A, 16B, and 17 show that the light plate 12 can be implemented by having LED strips 80 mounted on the light plate. The LED strips 80 include multiple LEDs 30, a circuit board with control circuits 82, and electrodes 84. As shown in FIG. 17, the LED strip can also be mounted on a heat sink 90 designed to absorb heat as required for the power consumed.

FIG. 18 shows various shapes of a spacer 52*a*-52*d* which is used in FIGS. 6-8. The spacer is preferably transparent or translucent. The spacer is placed over the light panel such that the LEDs are placed at a distance from the artwork layer 11 to be illuminated such that the light from the LEDs is spread out providing uniform illuminations for the print. The spacer can be made by molding or vacuum forming of plastic materials forming patterns of crests 94 and valleys 96 as shown. The ratio of crest and valley areas can be designed for maximum mechanical strength and least air current effect when operating under windy conditions. The crests and valleys have shapes that are rectangular or square 52*a*, triangular 52*c*, hexagonal 52*b*, random 52*d*, or any other shape as desired for specific application needs.

FIGS. 19-20 show another embodiment of the system in which a light panel is not required. Instead, the strips 92 containing a plurality of LEDs 30 are mounted directed onto the spacer 52. The crests 94 and valleys 96 of the spacer are design such that the spacer has sufficient mechanical strength and sturdiness for the mounting operations. FIG. 20 shows the cross-section of an embodiment in which the LED strips 92 are mounted in the valleys 96 of the spacer. The height of the crest is designed such that the artwork layer 11 is illuminated uniformly.

FIGS. 21-23 show another embodiment in which the spacers 52*r* are made, instead of in single panels, in a continuous fashion in the form of a ribbon with hinges 98, such as plastic living hinges. Such spacer ribbon 52*r* can be made and stored in rolls facilitating storage, transportation, and installation. Power to the LED strip can be supplied similar to that shown in FIG. 11 using two power lines. At installation, a length of spacer ribbon 52*r* is cut to size and the two electrodes will be available for connections to the power supply. As shown in FIG. 22, optional hinges 98 can be made by appropriate methods such that the spacer 52*r* can be rolled in a more flexible manner as shown in FIG. 23. The back of such space can also be equipped with mounting mechanisms such as double sided tapes, Velcro strips, etc., for ease of installation.

FIGS. 24-25 shows another embodiment in which the LED strips 92 are mounted on the back side of the spacer 52*r* with LEDs shining through the spacer. In this case, the output illumination can further be modified with various spacer structures, materials, transparency, translucency, color, surface features, etc.

The backlight system described has an array of backlight modules. The modules are made such that there are no gaps visible between the modules after the printed vinyl are placed over them. On the other hand, each module can be lit independently and each one will be clearly visible as an individual module as desired. With a special printing technology where multiple layers of images can be printed on the front and back of the vinyl, multiple graphic images can be displayed. For example, during daylight, the graphic image on the front will be displayed by the ambient light. At night, when the backlight is turned on, hidden images printed behind the outermost image at the front and images printed at the back can be displayed. With an array of backlight modules controlled independently, localized visual effects can be made. The terms day light versus night time are simply general descriptions of the lighting conditions from a brighter environment to a dimmer environment relative to the intensity of the backlight module. When the output of the backlight module overcomes the ambient light and the back images are visible, this will be considered as the night time condition. When the backlight is turned off and the front images are still visible, this will be considered as the day time condition. The system can be used indoors, where the ambient light level can be low and the day time and night time conditions will be defined accordingly. As the intensity and colors of the backlight panel can adjusted, various effects can be created that will be somewhere between the day time and night time conditions.

In order to protect the light panel from rain in outdoor installations, it will be covered by a transparent package 100 as shown in FIG. 26. The front of the backlight panel assembly is covered by the front spacer cover 102, which includes spacers providing uniform illumination of the poster or billboard prints. The spacer has pockets formed on the front spacer cover, which can be squares, rectangles, hexagons, and flat tops, dome tops, pointed tops, etc. The front spacer cover can be made by molding, vacuum forming, etc. and the material can be plastic, acrylic, polycarbonate, etc. The front spacer cover and the back cover are sealed 104 around the edges using glue, epoxy, or ultrasonic welding. A small opening, optionally sealed, will be provided for the LED wires. The LED wires are configured such that the terminals are available for connection at the top and the bottom of the light panel package.

Depending on the environment requirements, the light panel package can be totally sealed without leaks, or partially sealed with vent holes.

FIG. 27 shows one method on how the panels can be connected electrically. The wires from one light panel package can be connected to the next light panel package as shown using wire nuts. Other method can also be used including soldering, crimping, connectors, etc.

FIG. 28 shows an embodiment for connecting the light panel package mechanically such that it can be formed as a vertical array. It include a fixed C-plate mounted on the light panel package and connected to the next light panel package using a floating C-plate such that it hooks into both light panel packages as shown.

One or more tie wraps 110 can be used to hang the light plates 12 of each column relative to one another. FIG. 28 shows the use of two tie wraps, one on each side of the light panel package. These tie wraps can be fixed to the light panel package using various means including epoxy, mechanical mounting, ultra-sonic welding, etc. The tie wrap can be plastic or metal. When metal is used, it can also be used for inter-plate electric connections similar to the method shown in FIG. 11. During installation, the tail of the tie wrap of one panel is inserted in the socket of the next panel and pulled tight minimizing the spacing between the two panels.

FIGS. 29A-29B show a backlit billboard which includes an array of light panel packages 110 mounted onto the billboard frame 14. Printed vinyl spacers 112 are placed on top of the light panel packages 110 so that the artwork layer (not shown) will be lit from the back. When the light panel packages 110 are connected in parallel or in series, depending on the chosen circuit configuration, all the panels will either be on or off at the same time. To capture the attention of the viewers, it would be advantageous to control the light panel packages individually or in groups, such that a predetermined design patterns are produced at any given time and can be varied over time. A controller 114 can be added to each panel or to a group of light patent packages and connected by jumpers 116 as shown in FIG. 29(*b*). Alternatively, as shown in FIG. 30, each light panel package 110 can have its own controller 114. The controllers 114 can be custom circuits or industrial standard controllers, e.g., DMX controllers.

FIG. 31 shows a schematic diagram of a system with light panel packages 110, each having its own controller mounted on the package board, in which the controllers are connected by jumpers 116. A programmer 118 is coupled to a command unit 120, which in turn is connected to one of the controllers. The programmer 118 can be custom design hardware/software, or an industrial standard light control computer and software.

Each light panel 110 has LEDs as the illuminating light source. A single color LED can be used for the light panel. In addition, more than one color can be used such that the final color of the light panel can be controlled. The color can be white, red, green, blue, or any other colors desired. The exact color can be modified by controlling the relative intensity of each of the colored LEDs and all controls and be programmed into the Programmer 118 and executed by the controllers 114.

FIG. 32 shows an LED backlight module plate 12 illuminating a vinyl display sheet 130 having printed images and/or other information on both sides, i.e., a front image 132 and a back image 134. When the backlight is turned off and there is sufficient ambient light, the front image 132 will be displayed. Depending on the ambient brightness and the brightness of the backlight, the backlight can be turned on showing a combination of the front image 132 and back image 134. When the ambient light is very low, e.g. at night, and the LED backlight plates 12 are turned on, a full back image combined with the front image will be displayed. The front and back images can be designed such that the back image can overcome the front image by suitable use of image compositions and printing dye used. For example, a black dye at the back can block the backlight totally and the front image will not be seen at that particular location. Besides intensity of the white light, the use of colored light and colored images, and addressable location, allow various combinations of front and back images providing highly flexible design.

When each backlight plate 12 is set up with multiple colored LEDs, including white, red, green, blue, etc., even more images can be printed and displayed by varying the color of the backlight module matching to the color of the printed images. FIG. 33 shows a system with a controller 140 for receiving lighting information and drives the backlight panel's 120*a* RGBW LEDs accordingly. In this particular example, the back image consists of a red printed area 136 and a grey printed area 138. In the transparencies of the red and grey levels can be adjusted for the desired visual effects and contrasts. When the backlight module 12*a* is off, the front image 132 will be displayed. As the ambient light level lowers, the backlight module 12*a* can be turned on. If the backlight is white, the front image 132 will be illuminated by this backlight and become visible. When the backlight 12*a* is red, the area with red ink 136 will have higher intensity than the other grey areas 138. When blue or green colored LEDs of the backlight 12*a* are illuminated by the controller 140, the red ink will absorb these colored light and will appear dark at the output while the grey area will have blue or green light passing through illuminating the front image. In each case, the controller illuminates a particular color or colors of LEDs, depending upon which of the several displays are to be illuminated as the billboard display.

FIG. 34 shows a system similar to FIG. 33, where more color inks, for example, blue 140, green 142, and orange 144, are used and overlapping color inks are used. Other combinations of light colors and ink colors can be used to produce the desired images and effects.

FIG. 35 shows an example of part of a billboard display 11, similar to FIGS. 33-34, with a front image 132 including a tree and a house as examples. The back image 134 includes, again by example, rows of numbers of a bingo game. For a particular simple example, the backlight panels are all set to green. The back image will be all grey in color and the numbers are printed in green such that the densities of the grey and green inks are set to provide uniform output intensity in green. The grey will transmit partially blue and red light. The front image will then be illuminated with a uniform green backlight will be display as such. The number will not be visible. When a certain number needs to be shown, the color of the particular panel will be lit with another color, e.g. red. In this case, the area corresponding to this panel will become reddish as the red light will be transmitted through the grey area. On the other hand, the red light will not be transmitted through the red number and the number will be show as a dark image with a reddish background. This can be done to have any desired numbers turned on forming the display of a bingo game.

FIG. 36 shows another application of such display 11 with interactivity between the viewer 150 and the billboard 10. In this system, the billboard backlight plates 12*a* are controlled by a controller 140 connected either with wires 160 or by wireless communication hardware (not shown). At the same time, the viewer 150 can use a phone or tablet type of device 152 connected to the controller 140 directly either by wireless connection or indirectly via the web 154. The whole system will be managed by the central office 156 through the web 158 for specific functions to be implemented. For example, a merchant with a fast food chain can issue coupons through such interactivity. The central office 156 sends a message to the billboard controller to illuminate one or more selected backlight panels with a certain printed back image, e.g. image of a hamburger. As the image is displayed, the viewer, while running an APP provided by the merchant, can push a button on the phone/tablet to accepted a coupon to purchase a hamburger at a specified store or chain. Information concerning the coupon will then be transmitted to the viewer's device from the central office 156. With this stored coupon, the viewer can then claim the merchandise, which is a hamburger in this example, at the store. Such coupon campaign can be coordinated with the central office, the APP, and the printed billboard vinyl.

As previously mentioned, the LED backlight array can also be used in large displays which are smaller than billboards, but which are too large to be acceptably lit by a single LED backlight panel or plate. Such large displays are typically used in an indoor environment.

In an indoor environment with lower ambient light and higher backlight panel intensity, such interactivity will be functional throughout the day instead of night time only. Instead of the image of a hamburger, other message including pre-printed text can be displayed. With such display message/images and interactivities with the viewer, many types of promotional campaigns, games, surveys, etc. can be designed and implemented.

For convenience in installation of the light panels 12*c* onto the billboards and the like, secure connectors 162 are built into the light panels 12*c* such that they can be plugged onto the billboard with matching sockets. This system is indicated as the mechanical and/or electrical connector system in FIG. 37. Both mechanical and electrical connections are required as the light panel will both be held in place by such connector system and receive electrical power through the connector system. In one embodiment, four such connector systems 170 are used with two being electrical and two being mechanical such that when the light panel is plugged onto the backboard 172 of the billboard 10, the light panel receives the required electrical power and the connector system also secure the light panel. Such connector system can be frictional, or snap-fit, or designed to have latches for better attachment. Banana plugs can be used for the electrical connection and have certain of mechanical friction that can be used for this system. For more robust requirements, other connectors with mechanical latching would be needed.

In another embodiment where a larger light panel 12*d* is used, e.g. 2 feet by 2 feet, two LED array strips 176, one positioned along opposing sides of the panel 12*d*, are used as shown in FIGS. 38A and 38B. In order to minimize the gap between the lighted areas of the light panel, special arrangement has to be made as shown in FIGS. 39A and 39B. In this example, six light panels are used for demonstration. The same methodology can be used for a larger array of light panels. When light panel 1 is placed with the LED arrays on the top and bottom, light panel 2 on the right will have the LED arrays on the left and right of the panel. The rest of the light panels will be placed following the same scheme as shown. With such arrangement, the gap without light will have a spacing c only. If this is place with the LED arrays next to each other as shown, the spacing will become 2*c*, which is not desirable as dark shadow might show up on the illuminated prints.

In another embodiment, the connectors 162 are magnetic connectors such that there is a magnetic holding force and an electrical connection. The number of magnetic connectors used can be determined by the number of connections required and the amount of holding force required. Some of the magnetic connectors may be used only to increase the holding force without using the electrical properties.

Besides mounting the magnetic connectors on a board, these connectors can also be mounted on flexible materials such as a piece of vinyl or cloth. The magnetic force in the connector pulls the connection together and become self-aligning. Such flexible materials can be placed over a wall, a billboard, etc. with hooks, stretchable cords, etc. On the light panel side, the matching magnetic connectors and fixed to the light panel and the electrical connections can be made accordingly. Locking nuts or pins can be added to the flexible material and the light panel for more secure installation.

The present LED backlight invention, comprising a plurality of columns of LED plates, each column in turn being composed of a plurality of LED plates, can be used with large area displays other than billboards. Such other large area displays may, for example, be formed with an array of LCD screens or a large printed paper or vinyl poster. The backlight system can be implemented as multiple panels tied together forming a large backlight, or can be implemented as a flexible sheet, that can be rolled for ease of transportation. Multiple rolls can be used together forming an even large display. The backlight is supported by a frame.

FIG. 40 shows an example of an array 210 of backlight panels 200 which, as described below in connection with FIGS. 41A and 41B, each include an LED plate and an LCD in order to create a display or a large printed poster. In this particular example, the array includes six vertical columns, and each column has four modules, two top and bottom modules 212 and two center modules 214. The end modules are equipped with LED arrays 216. The center modules 214 do not have the LED) arrays.

FIG. 41A shows an edge-lit LED backlight module 220 which may be used as the modules 212 in FIG. 40. An array 222 of LEDs having a heat sink 224 is placed along the edge 226 of a diffusive light guide 228 with the output of the LEDs coupled into the diffusive light guide. The diffusive light guide 228 redirects light in the light guiding toward an LCD panel 230*n* on the front face of the module, i.e., in a direction perpendicular to the LED array 222, toward the LCD panel 230. Prism sheets 232 are preferably provided between the light guide 228 and the LCD panel 230 to confine the output angle of the light and to recycle un-used light back to the diffusive light guide for increase efficiency. There are many known methods for providing diffusion, redirecting light including structured surface 231 as shown in FIG. 41B, scattering centers, steps, and so on. The light guide 228 is preferably a planar waveguide with four sides having LED arrays 222 on one or more sides depending on the amount of light required. The sides that are not illuminated are preferably coated with reflective coating to reflect light back into the diffusive light guide.

In practice, there will be a uniformity requirement for the display, which limits the size of the display as the farther away from the LED Light source; the lower will be the intensity. To overcome this intensity decay in a large display system, this invention discloses a light guide system that will allows a large display with uniform intensity.

FIG. 42A shows the details of an end module 234 for the FIG. 40 display. It includes two LEDs arrays 236 one for the diffusive light guide 228, and one for a transmissive light guide 240. The diffusive light guide 228, as described previously, redirects light for illuminating the LCD display. The transmissive light guide 240 transfers the output of the LED array to the center module with minimum loss. For illuminating posters, the LCD display is replaced by printed contents on paper, vinyl, or other printed materials.

FIG. 42B shows the details of a center module. It includes a transmissive light guide 240 and a diffusive light guide 228 as shown. The diffusive light guide redirects light towards the LCD panel 236. The transmissive light guide 240, in this case, is not transferring any light in the light guiding direction, but instead, it is transparent for transmission of light from the diffusion light guide to the LCD panel. This light guide is used to keep the spacing of the diffusive light guide at the same position as the transmissive light guide of the end module such that the LCD displays are at the same plane.

FIG. 42A shows two LED arrays being used, one for each light guide 228, 240. In practice, a single LED array can be used provide light inputs for both light guides.

FIG. 43 shows another embodiment where three LED modules 222 are used with one end module and two center modules. In this case, each module will have one diffusive light guide 228 and two transmissive light guides 240 as shown. The three diffusive light guides 228 are staggered relative to one another, rather than being arranged side-by-side. More modules can be added by simple increasing the number of center modules and number of light guides under each module. Again, the LED arrays can be combined in one or more arrays instead of having one array for each light guide.

The light guides can be made with glass, plastic, acrylic, or other low loss optical materials. Each light guide can be made with a single material using air as the cladding, or can be made with center core guiding material and top/bottom cladding materials with lower refractive index. When air is used as a cladding, there will be a need to include a small air gap between the light guides. When cladding layers are included, the light guides can be glued together forming an integral unit.

Although the description above have each illumination module matched to an LCD display panel, in practice, the illumination modules can be independent of the LCD panels and can have different dimensions.

Instead of implementing such system using panels, it can also be implemented using flexible light guide in the form of sheets as shown in FIG. 44. These light guides preferably are made with a center layer of core guiding material sandwiched between two cladding layers with lower refractive index. This way, the light guides can be glued together; otherwise, an air gap has to be maintained between light guides.

FIG. 44 shows an example of such flexible light guide back light system. In this example, four light guides 250 are used with four display output areas A, B, C, and D. On end 252 of the assembly is reflective. This back light system can be stored and transported in the form of a roll with the LED illumination system attached to the edge of the roll, or as a separate unit to be attached to the light guide during installation. The light guide can also be integrated with the prism sheets, not shown, for added efficiency. This illumination system can be used for back lighting LCD panels or printed posters. Multiple rolls can be used side by side for large areas. For longer display areas, more layers and output areas can be used.

The foregoing description represents the preferred embodiments of the invention. Various modifications will be apparent to persons skilled in the art. All such modifications and variations are intended to be within the scope of the invention, as set forth in the following claims.

The invention claimed is:

1. A billboard comprising:

a frame;

an artwork layer;

a plurality of LED light plates, each of said plurality of LED lights plates comprising an array of LEDs for emitting light from a surface of each light plate, which surface faces the artwork layer; wherein said light plates are arranged in a plurality of adjacent columns, and wherein each column includes a plurality of rows containing a light plate, wherein said light plates are supported by the billboard frame; wherein a gap exists between adjacent light plates in each said column and each row in each column;

a diffuser plate positioned between said artwork layer and said plurality of LED light plates; and a light transmitting spacer mounted directly on each of said light plates and comprising a sheet of clear plastic with a surface facing said artwork layer, said surface having a plurality of hills and valleys to allow light emitted from each of said light plates to expand before reaching said artwork layer thereby providing a uniform backlight for the artwork layer.

2. The billboard of claim 1, wherein each of said LED light plates comprises an edge, wherein said array of LEDs are provided on said edge to form an edge-lit LED light plate.

3. The billboard of claim 1, wherein each of said LED light plates comprises a flat surface, wherein said array of LEDs are provided on said flat surface to project light toward said artwork layer.

4. The billboard of claim 1, wherein each of said LED light plates has a flat surface, wherein said array of LEDs is in the form of at least one LED strip provided on said flat surface to project light toward said artwork layer.

5. The billboard of claim 1, wherein said light transmitting spacer comprises a plurality of adjacent air pockets.

6. The billboard of claim 1, wherein said LED light plates of each of said columns are hung from common wiring to permit each column, prior to forming said billboard, to be rolled or folded and then unrolled or unfolded during formation of the billboard.

7. The billboard of claim 1, wherein each of said LED light plates is approximately one-half foot times one-half foot in dimension.

8. The billboard of claim 1, wherein each of said LED light plates in each column is supported by C-clamps to the LED light plate above it.

9. The billboard of claim 1, wherein at least some of said LED light plates have their own drivers, said billboard further comprising a controller to control the LEDs of said LED light plates having their own drivers to act as a pixel in order to vary the display of the billboard.

10. The billboard of claim 1, wherein the artwork layer comprises a first artwork layer on its outer surface and a second artwork layer on its inner surface.

11. The billboard of claim 1, wherein said LED light plates comprise a transmissive light guide and a diffusive light guide.

* * * * *